US005214238A

United States Patent [19]

Young

[11] Patent Number: 5,214,238

[45] Date of Patent: May 25, 1993

[54] SABOT FOR CHAMBERING CONVENTIONAL BULLETS IN A SHOTGUN

[76] Inventor: Christopher Young, 34 Wagner Ave., Trenton, N.J. 08561

[21] Appl. No.: 856,356

[22] Filed: Mar. 23, 1992

[51] Int. Cl.[5] ..... F42B 14/06

[52] U.S. Cl. ..... 102/520; 102/439; 102/448; 102/521

[58] Field of Search ..... 102/520, 521, 522, 524, 102/439, 448

[56] References Cited

U.S. PATENT DOCUMENTS

| | | | |
|---|---|---|---|
| 3,005,408 | 10/1961 | Prosen et al. | 102/522 |
| 4,644,865 | 2/1987 | Lawrence | 102/520 |
| 4,676,169 | 6/1987 | Maki | 102/448 |
| 4,735,148 | 4/1988 | Holtzman et al. | 102/522 |
| 4,829,904 | 5/1989 | Sullivan | 102/439 |
| 4,841,867 | 6/1989 | Garrett | 102/520 |
| 5,014,624 | 5/1991 | Baxter et al. | 102/523 |

FOREIGN PATENT DOCUMENTS

| | | | |
|---|---|---|---|
| 1800758 | 6/1970 | Fed. Rep. of Germany | 102/520 |
| 2401399 | 3/1979 | France | 102/522 |
| 49010 | 10/1990 | Switzerland | 102/522 |
| 2013312 | 8/1979 | United Kingdom | 102/520 |

*Primary Examiner*—David H. Brown
*Attorney, Agent, or Firm*—Sachs & Sachs

[57] ABSTRACT

A sabot for retaining therein a conventionally shaped tapered-nose bullet when the sabot is seated in place in a shotgun shell casing, so that the shotgun can be used to fire conventional lead or copper jacketed lead bullets in a shotgun. The sabot includes a unitary body having a cylindrical portion and a truncated conical portion, the cylindrical portion and the truncated conical portion sharing a common longitudinal axis, the conical portion having a wide diameter at one end thereof and a narrow diameter at the other end thereof, the narrow diameter end being adjacent to the cylindrical portion, the unitary body having longitudinally disposed therein a chamber, the longitudinally disposed chamber for receiving therein a conventionally shaped tapered-nose bullet, the unitary body being distortable such that the wide diameter of the conical portion can assume a diameter substantially the same as the interior diameter of the shotgun shell casing when the unitary body is inserted therein, the distortion of the unitary body causing impingement of the longitudinal chamber on the tapered-nose of the conventionally shaped tapered-nose bullet, said distortion for retaining in the longitudinal chamber the conventionally shaped tapered-nose bullet, release of the unitary body from the shotgun shell causing the unitary body to return to the undistorted shape thereof so as to release the conventionally shaped tapered-nose bullet.

15 Claims, 2 Drawing Sheets

SABOT FOR CHAMBERING CONVENTIONAL BULLETS IN A SHOTGUN

BACKGROUND AND/OR ENVIRONMENT OF THE INVENTION

1. Field of the Invention

The present invention relates to apparatuses which permit firing of a conventionally shaped tapered-nose bullet from a conventional shotgun and more particularly a sabot for retaining therein a conventionally shaped tapered-nose bullet in a sabot for insertion in a shotgun shell casing and for chambering in a conventional shotgun.

2. Description of the Contemporary and/or Prior Art

Because of laws adopted in various jurisdictions, sportsmen are precluded from using rifles for certain types of hunting. However, it is well known that use of a bullet rather than lead shot is highly desirable. The subject invention permits compliance with the law and also achieves the desired result in that it permits the user of a shotgun to chamber and fire a bullet therein.

The desirability of chambering a single conventionally shaped projectile in a shotgun shell is well known in the art. There have been longstanding attempts to do so and most prior art attempts either resort to use of a specially shaped bullet with a casing that conforms to the shape of the bullet, or suffer from inadequate retention of the bullet in the sabot. This causes accidental displacement of the bullet from the sabot which leads to at best inaccuracy, and at worst a dangerous situation.

When the sabot is specially shaped and conforms to a specially configured bullet, there is difficulty in that the sabot may continue to fly with the projectile as it exits the shotgun causing unstable flight and therefore lack of accuracy as well as diminished distance. Also, injury to innocent bystanders may result when the sabot separates from the projectile.

U.S. Pat. No. 1,794,141 issued to Bloc-Jorgensen on Feb. 24, 1931 teaches a cartridge with projectile for smooth bore firearms wherein a specially shaped bullet is partially retained within the cartridge by a plurality of segmented wadding rings that are separated from the bullet after firing.

Also teaching specially configured bullets are U.S. Pat. No. 3,726,231 issued on Apr. 10, 1973 to Kelly et al and French Patent 2,352,272 issued to Ontato on Jan. 20, 1978. Both of these patents teach the use of a sabot which conforms to a specially shaped bullet and both suffer from the same infirmity in that the bullet is not released from the sabot immediately upon its firing from a shotgun therefore causing the problems as previously described, and a lack of an ability to use conventional bullets.

U.S. Pat. No. 4,676,169 issued to Maki on Jun. 30, 1987 teaches a slug assembly for shotgun shells where the slug or bullet is specially shaped and frictional retention is employed. Aside from not being able to guarantee retention of the bullet therein the less than desirable aerodynamic properties of the bullet are also suffered.

Although not directly analogous to the subject invention, sabots are also known for channeling a subcaliber bullet in pistols or rifles For example, U.S. Pat. No. 3,164,092 issued to Reed et al on Jan. 5, 1965 and U.S. Pat. No. 4,239,006 issued to Kelson on Dec. 16, 1980 each teach a sabot which includes a longitudinal chamber for receiving therein a conventionally shaped that is retained for firing in a larger bored firearm. Although the bullets are conventionally shaped, no means are shown or suggested for retaining the bullets therein other than frictional engagement. Unfortunately, this proves to be basically unsatisfactory in that the bullets cannot be adequately maintained in position and may fall out of the sabot. Further, if such configuration was used in a shotgun, the problem would be amplified by virtue of the inability to structurally maintain frictional engagement because of the relatively flexible nature of a shotgun cartridge.

U.S. Pat. No. 686,375 issued to Wheeler on Nov. 12, 1901 teaches a subcaliber cartridge or sabot comprised of wood which includes a chamber in which a vertical projectile can be placed prior to the forcing of the projectile into a small arms cartridge. As in well known in the art, small arms cartridges are essentially constructed of brass and are relatively rigid. While such a configuration may hold a vertical projectile in position in a hard case, such would be totally unsuitable for use in a soft shotgun shell. A wooden cylinder cartridge is also shown in U.S. Pat. No. 115,498 issued to Milbank on May 30, 1871.

In reviewing the modern prior art as shown in Maki, Ontato, and Kelly et al it is clear that the present trend in the art is toward employing of specially configured bullets rather than readily available conventionally shaped bullets, and as shown in Kelly and Ontato, these require complimentarily configured sabots for engagement. Further, the configuration shown in Maki not only employs a specially shaped bullet, but also suffers from the infirmity of mere frictional engagement.

The subject invention overcomes the problems associated with the prior art by providing a sabot for retaining therein a conventionally shaped tapered-nose bullet which is dimensionally engaged by the sabot, but which is readily freed therefrom when fired from a shotgun. As a result, the flight of the bullet is highly accurate and the danger and infirmity of having the sabot carried along with the bullet towards its target is avoided.

SUMMARY OF THE INVENTION

Therefore, a primary object of the present invention is to provide a sabot for retaining therein a conventionally shaped tapered-nose bullet.

A further object of the present invention is to provide a sabot for retaining therein a conventionally shaped bullet, wherein the bullet is quickly and simply released from the sabot upon the sabot leaving the shotgun muzzle so that the sabot is not inordinately carried toward the target.

A still further object of the present invention is to provide a sabot for retaining therein a conventionally shaped bullet so that the conventionally shaped bullet can be fired from a shotgun thereby avoiding restrictions of the firing of such solid projectiles imposed by law.

Still another further object of the present invention is to provide a sabot for retaining therein a conventionally shaped tapered nose bullet which does not interfere with the aerodynamic properties of the bullet as it is fired toward a target.

An additional object of the present invention is to provide a sabot for retaining therein a conventionally shaped tapered-nose bullet which can be readily mass produced.

Another further object of the present invention is to provide a sabot for retaining therein a conventionally shaped tapered-nose bullet which is simple in design, inexpensive to manufacturer, rugged in construction, easy to use, and efficient in operation.

These objects as well as further objects and advantages of the present invention will become readily apparent after reading the ensuing description of several non-limiting illustrative embodiments and viewing the accompanying drawings.

A sabot for retaining therein a conventionally shaped tapered-nose bullet when the sabot is seated and placed in a shotgun shell casing, according to the principles of the present invention, includes a unitary body having a cylindrical portion and a truncated conical portion, the cylindrical and the truncated conical portions sharing a common longitudinal axis, the conical portion having a wide diameter at one end thereof and a narrow diameter at the other end thereof, the narrow diameter end being disposed adjacent to the cylindrical portion, the unitary boy having longitudinally disposed therein chamber, the longitudinally disposed chamber for receiving therein a conventionally shaped tapered-nose bullet, the unitary body being distortable such that the wide diameter of said conical portion can assume a diameter substantially the same as the interior diameter of the shotgun shell casing when the unitary body is inserted therein, the distortion of the unitary body causing impingement by the longitudinal chamber on the tapered-nose of the conventionally shaped tapered-nose bullet, the distortion for retaining in the longitudinal chamber the conventionally shaped tapered-nose bullet, release of the unitary body from the shotgun shell causing the unitary body to return to the undistorted shape thereof so as to release the conventionally shaped tapered-nose bullet.

BRIEF DESCRIPTION OF THE DRAWINGS

In order that the present invention may be more fully understood, it will now be described, by way of example, with reference to the accompanying drawings in which.

DESCRIPTION OF THE PREFERRED EMBODIMENTS

Figure 1:
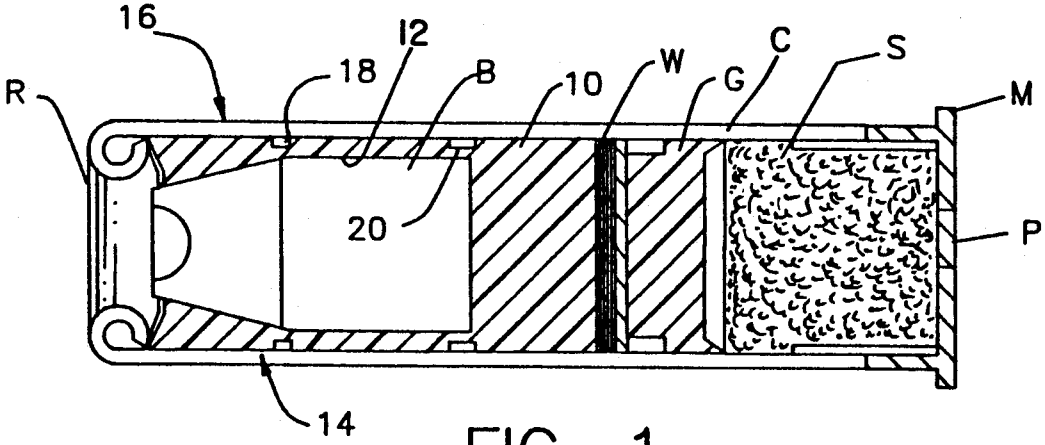
FIG. 1 is a cross sectional view of a shotgun shell casing having disposed therein a sabot constructed in accordance with the principles of the present invention.
Figure 2:
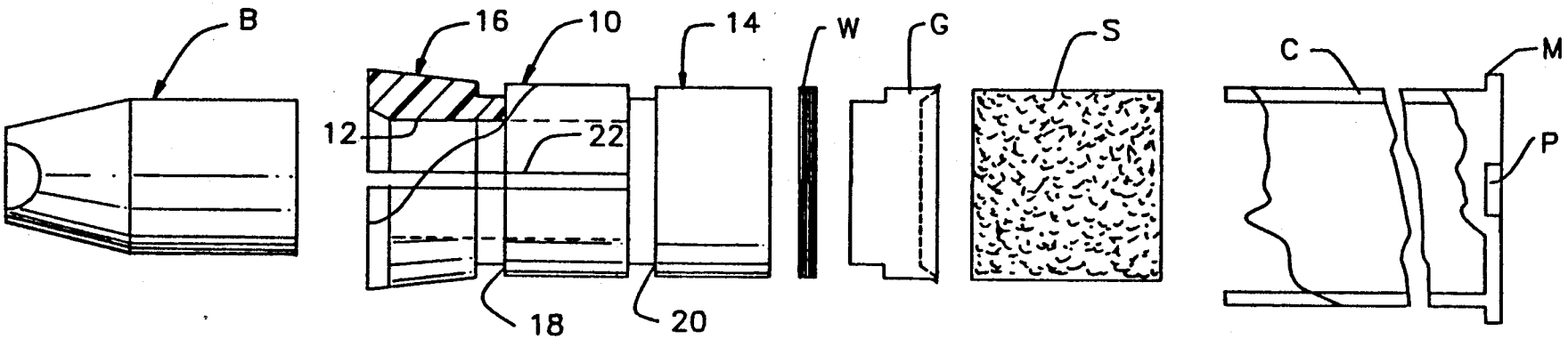
FIG. 2 is an exploded view of the assembly of FIG. 1.

Referring now to the figures, and more particularly to FIGS. 1 and 2 thereof, there is illustrated therein a sabot 10 constructed in accordance with the principles of the present invention. The sabot 10 has disposed therein a bullet B in a longitudinal chamber 12, disposed in the sabot 10. In turn, the sabot 10 is disposed in a shotgun shell casing C of conventional design which includes a customary metal end portion M, having disposed therein a conventional percussion cap P. Also disposed within the casing C is wadding material W, a gas seal G and a premeasured quantity of conventional commercially manufactured smokeless gunpowder S.

The sabot 10 is of unitary construction and is preferably formed from a single piece of plastic material such as high density polyethylene or other suitable material. An essential characteristic of the material from which the sabot is constructed is that the material has a "memory" which permits the material, when distorted or deformed by pressure, to assume its shape prior to being deformed and distorted when the pressure is released. For simplicity and clarity, a material having such a memory characteristic shall be identified herein as distortable.

The sabot 10 includes a substantially cylindrical portion 14 and a substantially truncated conical portion 16. The truncated conical portion 16 has a wide diameter at one end thereof and a narrow diameter at the other end thereof, the narrow diameter coinciding with the diameter of the cylindrical portion 14. The truncated conical portion 16 is shown in a distorted shape in FIG. 1 and in an at rest shape in FIG. 2, as will be hereinafter described. Sabot 10 also has disposed in the outer surface thereof a pair of annular grooves 18 and 20. The annular grooves 18 and 20 are preferably substantially parallel to each other and are preferably disposed normal to the longitudinal axis of the sabot 10, the longitudinal axis of the longitudinal chamber 12 preferably coinciding with the longitudinal axis of the sabot 10 to produce a fully symmetrical configuration.

As can be seen by viewing FIG. 1, the substantially truncated conical portion 16 of the sabot 10, at its narrowest diameter, is substantially the same as the largest external diameter of the cylindrical portion 14 and this diameter is also substantially the same as the interior diameter of the shotgun shell casing C. The shotgun shell casing C is of conventional manufacture and may be constructed of specially treated cardboard or plastic as is well known in the art.

Figures 3, 4, 5, 6, 7, 8:
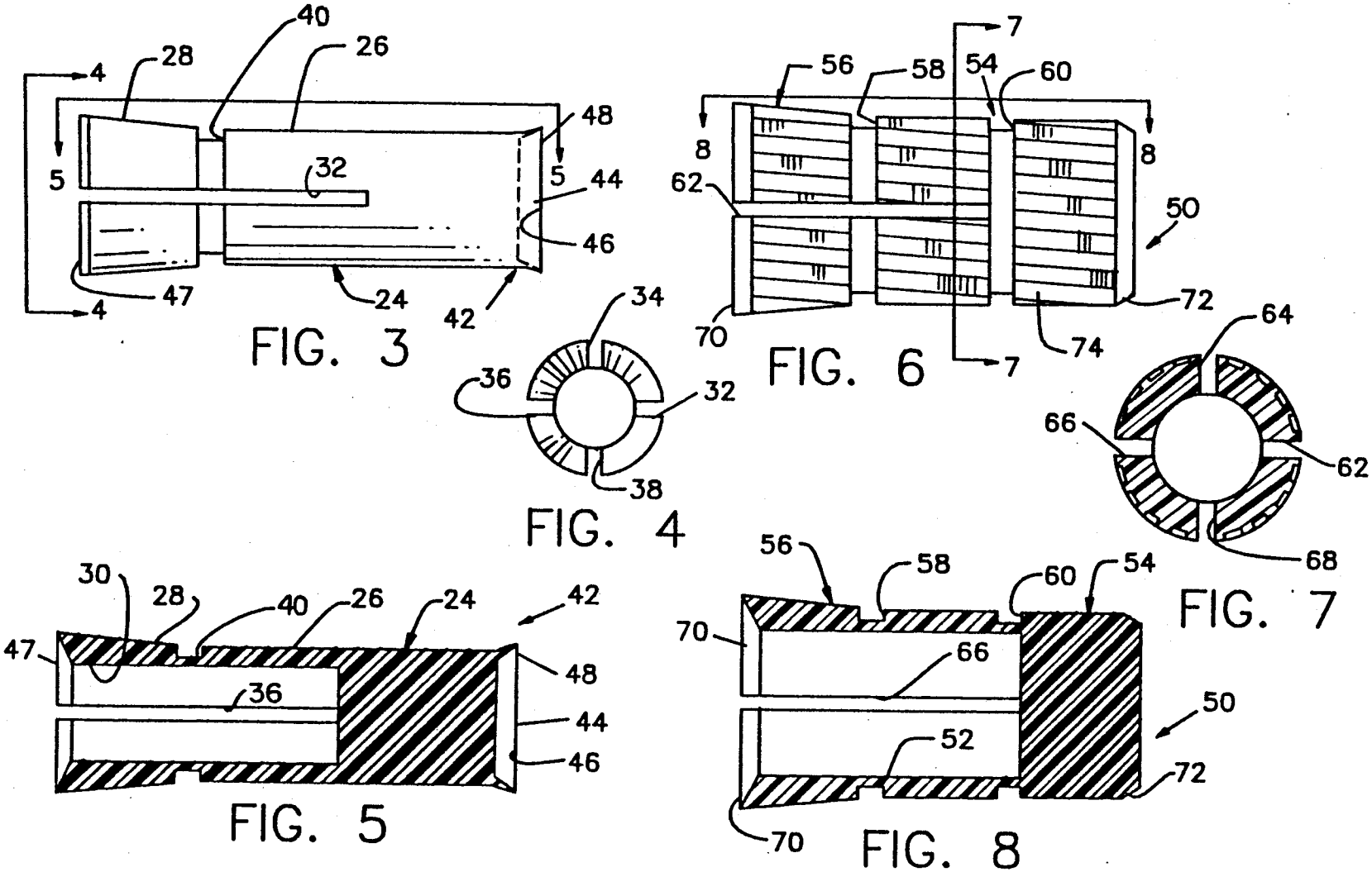
FIG. 3 is an alternate embodiment of the subject invention.
FIG. 4 is an end view taken from the lines 4—4 of FIG. 3.
FIG. 5 is a cross sectional view of the embodiment of FIG. 3 taken along the lines 5—5 thereof.
FIG. 6 is a sabot constructed in accordance with the principles of the present invention shown in still another embodiment.
FIG. 7 is a cross sectional view taken substantially along the lines 7—7 of FIG. 6.
FIG. 8 is a cross sectional view of the embodiment of FIG. 6 taken substantially along the lines 8—8 of FIG. 6.

The sabot 10 also includes several radially disposed slots 22, only one of which is shown in FIG. 2. The radially disposed slots 22 preferably are four in number and would be configured as the similar slots shown in FIGS. 4 and 7 are configured. Specifically, the slots are spaced equidistant about the longitudinal axis of the unitary body and facilitate the distortion or deformation of the truncated conical portion 16. Similarly, the annular grooves 18 and 20 weaken the sabot 10 such that the distortion of the sabot 10 at its longitudinal chamber 12 can take place to conform to the conventionally shaped tapered-nose bullet B. It is to be understood that annular grooves, slots, other similar constructions and combinations thereof can be employed within the scope of the present invention.

The bullet B as illustrated is of a conventional hollow nose point copper jacketed configuration. It is to be understood that other conventionally shaped tapered-nose bullets well known in the art can be retained within the sabot 10 in accordance with the principles of the subject invention.

The essential relationship between the sabot 10 and the bullet B is that as the sabot 10 is forced into casing C while the bullet B is disposed within the sabot 10, the conical portion 16 distorts or deforms so that it assumes a maximum outer diameter substantially the same as that of the internal diameter of the casing C and as a result the longitudinal chamber 12 impinges upon the tapered-nose portion of the bullet B to firmly retain it within the sabot 10.

The assembly of shotgun shells is well known in the art and in accordance with the preferred embodiment of the present invention would proceed as follows:

A smokeless powder charge, selected in a conventional manner, would be loaded into conventional shotgun casing C having a percussion cap P disposed therein. Next, a plastic gas seal G would be inserted over the powder to retain it in position and conventional wadding material W would be inserted into the chamber of the casing C, over the gas seal G as shown assembled in FIG.

1. A suitable projectile or bullet would then be placed in the sabot 10 so that the front end of the bullet would face the open end of the sabot 10. This bullet would be of a conventional type and it has been proven that 0.240 grain to 0.300 grain (0.451 or 0.452 inch diameter bullets made by Hornady, Sierra, Speer and others) can be readily employed. The sabot 10, constructed in accordance with the principles of the present invention, is then inserted into the casing C and the casing C is crimped, preferably using an eight star crimp or a roll crimp as shown in FIG. 1. FIG. 2 illustrates the casing C prior to a crimp.

As can be readily ascertained when viewing FIG. 1 in conjunction with FIG. 2, the truncated conical portion 16 of the sabot 10 is distorted when the sabot 10 is inserted within the casing C and as a result there is positive dimensional engagement between the walls of the longitudinal chamber 12 and the forward conical portion of the bullet B, thereby retaining the bullet B in position. When the fully assembled shotgun shell is chambered in a shotgun and the percussion cap P is struck by a firing pin, the smokeless gun powder S is ignited. Because the rapidly produced gases are initially contained by the gas seal G, gas seal G is forced out of the open end of the casing C, propelling the wadding W and in turn the sabot 10. Propelled along with the sabot 10 is the bullet B and both leave the casing C together. However, because of the memory of the material from which the sabot 10 is constructed, the sabot 10, upon leaving the casing C, immediately reassumes its shape as shown in FIG. 2. As a result, the bullet B readily leaves the sabot 10. Because of the difference in relative densities of the bullet B and the sabot 10, the bullet B can travel toward its target in an unfettered, stable and conventional ballistic pattern. As a result, the bullet B is provided a rifle type delivery even though fired from a shotgun.

The annular groove 18 is preferably disposed in the sabot 10 at a point where the bullet B begins tapering and therefore which coincides with the interface between the tapered conical portion 16 and the cylindrical portion 14 of the sabot 10.

Although annular grooves 18 and 20 are shown to aid the deformation of the sabot 10, their necessity and location can be varied within the spirit and scope of the invention. For example, if a softer composition plastic is used suitable distortion or deformity may be possible without the grooves 18 and 20.

Referring now to FIGS. 3, 4, and 5 of the drawing, there is shown therein a sabot 24 constructed in accordance with the principles of the present invention. Sabot 24 includes a cylindrical portion 26 and a truncated conical portion 28. Disposed within the sabot 24 is a longitudinal chamber 30 dimensioned to receive therein a bullet of a conventional tapered-nose type, not illustrated. The longitudinal axis of the chamber 30 coincides with the longitudinal axis of the sabot 24 and disposed in the sabot 10 is a plurality of radially disposed slots 32, 34, 36 and 38. Slots 32, 34, 36 and 38 extend from the outer surface of the sabot 24 into the longitudinal chamber 30 thereof. Also disposed in the sabot 24 is an annular groove 40, the annular groove 40 and the longitudinal and radially disposed slots 32, 34, 36 and 38 facilitating the distortion or deformation of the sabot 24 to capture and dimensional engage a bullet B when the sabot 24 is inserted into a conventional shotgun shell casing such as C in FIG. 2.

Aside from having only one annular groove, sabot 24 differs from sabot 10 in that the rearward section 42 thereof has incorporated therein a gas seal portion 44. The gas seal portion 44 includes a concave section 46 which extends to a thin wall 48, the concave section 46 and thin wall 48 being of conventional design. The gas seal portion 44 can be incorporated into a sabot if the sabot is used with a cartridge that is consistently loaded with the same charge of a specific powder type and if its dimensions are calculated to accommodate such charge and powder type. A result of forming a gas seal in the sabot is that assembly is therefore simplified. The end 47 of the sabot 24 is conically tapered inwardly towards to the longitudinal chamber 30, to aid the seating of a bullet B therein and to aid aerodynamically in the release of the bullet B when the sabot 24 is projected from a casing C.

It should be understood that the disposition of the slots 32, 34, 36 and 38 in the sabot create a plurality of what can be best described as fingers which engage the tapered-nose portion of a bullet and which release the same when the sabot is fired. It also should be understood that the same effect can be achieved with a greater or lesser number of longitudinal slots and, the provision and location of one or more annular grooves such as groove 40. Therefore, the flexibility of the material from which the sabot is constructed, the size and location of annular grooves and the dimensions and location as well as number of radially disposed slots can be balanced and selected to achieve the desired result within the principles and scope of the subject invention.

Referring now to FIGS. 6, 7 and 8, there is disclosed therein a sabot 50 which incorporates the principles of the subject invention. The sabot 50 has a longitudinal chamber 52. The sabot 50 includes a substantially cylindrical portion 54 and a truncated conical portion 56. Also disposed in the sabot 50 are a plurality of annular grooves 58 and 60. Four regularly disposed slots 62, 64, 66 and 68, are disposed through the walls of the sabot 50 and open into the longitudinal chamber 52. Forward edge 70 and trailing edge 72 of the sabot 50 can be tapered as shown within the spirit and scope of the invention. Further, the interior of the forward edge 70 can also be conically tapered inwardly for the same purposes disclosed in regard to FIGS. 3 through 5. The sabot 50 differs from sabots 10 and 24 in that it includes rifling 74 that is externally angled grooves cut into the outer surface of the sabot 50 in the same manner that rifling is cut into slugs intended for use in unrifled smooth bored barrels to aid the accuracy and performance of a weapon.

It will be understood that various changes in the details, materials, arrangements of parts, and operational conditions which have been herein described and illustrated in order to explain the nature of the invention, may be made by those skilled in the art within the principles and scope of the invention.

Having thus set forth the nature of the invention what is claimed is:

1. A sabot for retaining therein a conventionally shaped tapered-nose bullet when said sabot is seated in place in a shotgun shell casing, said sabot comprising a unitary body having a cylindrical portion and a truncated conical portion, said cylindrical portion and said truncated conical portion sharing a common longitudinal axis, said conical portion having a wide diameter at one end thereof and a narrow diameter at the other end thereof, said narrow diameter end being disposed adjacent to said cylindrical portion, said unitary body having longitudinally disposed therein a chamber, said longitudinally disposed chamber for receiving therein a conventionally shaped tapered-nose bullet, said unitary body being formed of a distortable material such that said wide diameter of said conical portion can assume a diameter substantially the same as the interior diameter of the shotgun shell casing when said unitary body is inserted therein, the distortion of said unitary body causing impingement of said longitudinal chamber on the tapered-nose of the conventionally shaped tapered-nose bullet, said distortion for retaining in said longitudinal chamber the conventionally shaped tapered-nose bullet, release of said unitary body from said shotgun shell causing said unitary body to return to the undistorted shape thereof so as to release the conventionally shaped tapered-nose bullet.

2. A sabot in accordance with claim 1, wherein said wide diameter end of said conical portion is conically tapered inwardly toward said chamber.

3. A sabot in accordance with claim 1, further comprising spiral rifling in the outer surface of said unitary body.

4. A sabot in accordance with claim 1, further comprising at least one annular groove disposed in said unitary body.

5. A sabot in accordance with claim 4, wherein said at least one annular groove is disposed where said narrow diameter end of said truncated conical portion is adjacent to said cylindrical portion.

6. A sabot in accordance with claim 1, wherein said cylindrical portion of said unitary body has formed a gas seal in the end thereof not adjacent to said conical portion of said unitary body.

7. A sabot in accordance with claim 6, wherein said cylindrical portion of said unitary body is flared outwardly adjacent to said recess to form said gas seal.

8. A sabot in accordance with claim 1, wherein said unitary body has at least one radially disposed slot extending from the outer wall of said unitary body into said chamber, said at least one radially disposed slot facilitating the distortion of said unitary body.

9. A sabot in accordance with claim 8, wherein said at least one slot extends longitudinally from said wide diameter end of said conical portion into said cylindrical portion.

10. A sabot in accordance with claim 8, wherein said at least one slot comprises a plurality of radially disposed slots spaced equally about the longitudinal axis of said unitary body, said at least one radially disposed slot facilitating the distortion of said unitary body uniformly.

11. A sabot in accordance with claim 10, wherein the longitudinal axis of said longitudinally disposed chamber coincides with the longitudinally axis of unitary body.

12. A sabot for retaining therein a conventionally shaped tapered-nose bullet when said sabot is seated in place in a shotgun shell casing, said sabot comprising a unitary body having a cylindrical portion and a truncated conical portion sharing a common longitudinal axis, said conical portion having a wide diameter at one end thereof and a narrow diameter at the other end thereof, said narrow diameter end being disposed adjacent to said cylindrical portion, said unitary body having longitudinally disposed there a chamber, said longitudinally disposed chamber for receiving therein a conventionally shaped tapered-nose bullet, said unitary body having at least one radially disposed slot extending from the outer wall of said unitary body into said chamber, the longitudinal axis of said longitudinally disposed chamber coinciding with the longitudinal axis of said unitary body, said at least one slot extending longitudinally from said wide diameter end of said conical portion into said cylindrical portion, said wide diameter end of said conical portion being conically tapered inwardly toward said chamber, said unitary body having disposed therein at least one annular groove where said narrow diameter end of said truncated conical portion is adjacent to said cylindrical portion, said unitary body being formed of a distortable material, such distortion being facilitated by said at least one radially disposed slot and said at least one annular groove such that said wide diameter of said conical portion can assume a diameter substantially the same as the interior diameter of the shotgun shell casing when said unitary body is inserted therein, the distortion of said unitary body causing impingement of said longitudinal chamber on the tapered-nose of the conventionally shaped tapered-nose bullet, said distortion for retaining in said longitudinal chamber the conventionally shaped tapered-nose bullet, release of said unitary body from said shotgun shell causing said unitary body to return to the undistorted shape thereof so as to release the conventionally shaped tapered-nose bullet.

13. A sabot in accordance with claim 12, wherein said at least one slot comprises a plurality of radially disposed slots spaced equally distant about the longitudinal axis of said unitary body.

14. A sabot in accordance with claim 12, further comprising spiral rifling in the outer surface of said unitary body.

15. A sabot in accordance with claim 12, wherein said cylindrical portion of said unitary body has formed a gas seal in the end thereof not adjacent to said conical portion of said unitary body.

* * * * *